US007467963B2

(12) United States Patent
Chen

(10) Patent No.: US 7,467,963 B2
(45) Date of Patent: Dec. 23, 2008

(54) LOCKING STRUCTURE FOR CARD EDGE CONNECTOR

(75) Inventor: Kuan-Wu Chen, Taipei Hsien (TW)

(73) Assignee: Molex Incorporated, LIsle, IL (US)

( * ) Notice: Subject to any disclaimer, the term of this patent is extended or adjusted under 35 U.S.C. 154(b) by 0 days.

(21) Appl. No.: 11/879,563

(22) Filed: Jul. 18, 2007

(65) Prior Publication Data

US 2008/0050962 A1 Feb. 28, 2008

(30) Foreign Application Priority Data

Jul. 18, 2006 (TW) ..... 95212585 U

(51) Int. Cl.
*H01R 13/62* (2006.01)

(52) U.S. Cl. ..... 439/328; 439/327

(58) Field of Classification Search ..... 439/326, 439/327, 328

See application file for complete search history.

(56) References Cited

U.S. PATENT DOCUMENTS

| | | | | |
|---|---|---|---|---|
| 5,216,578 | A * | 6/1993 | Zenitani et al. | 361/690 |
| 5,383,793 | A * | 1/1995 | Hsu et al. | 439/327 |
| 6,331,940 | B1 * | 12/2001 | Lin | 361/785 |
| 6,700,788 | B2 * | 3/2004 | Matsushita et al. | 361/737 |
| 7,209,365 | B2 * | 4/2007 | Chang | 361/801 |

* cited by examiner

*Primary Examiner*—Tho D Ta
(74) *Attorney, Agent, or Firm*—Charles S. Cohen

(57) ABSTRACT

A locking structure for a card edge connector includes a pair of locking devices attached on both sides of the circuit board spaced from the connector housing. The two locking devices and the connector housing define a card receiving space. Each locking device has first and second locking portions. Through this arrangement, the locking structure allows the insertion of two electronic cards having identical interfaces but different lengths.

13 Claims, 6 Drawing Sheets

LOCKING STRUCTURE FOR CARD EDGE CONNECTOR

BACKGROUND OF THE INVENTION

The present invention relates to a locking structure for a card edge connector, and in particular to a locking structure for a card edge connector that cooperates with the connecting head of the card edge connector to hold the side edges of two electronic cards having identical interfaces but different lengths.

The main board of an electronic device is provided thereon with various card edge connectors for receiving various modulized electronic cards, so that electrical contacts on the side edge of each electronic card can be brought into electrical contact with the conductive terminals of a corresponding card edge connector, thereby forming an electrical connection between the electronic card and the main board. Each electronic card needs to be held in a corresponding card edge connector, so that stable contact between the electrical contacts and the conductive terminals can be assured. Therefore, in addition to a connecting head having conductive terminals, the card edge connector includes a locking structure or means for holding an electronic card in place.

The conventional locking means for an electronic card can only lock an electronic card of a single length; it cannot be applied to electronic cards having different lengths. Therefore, it is necessary to provide another locking means for electronic cards having different lengths. However, this causes an increase in production costs. Thus, with the development of new technologies, it is important for the locking means for a card edge connector to be correspondingly applied to electronic cards having different lengths.

SUMMARY OF THE INVENTION

An object of the present invention is to provide a locking structure or means for a card edge connector in which the two locking portions of two latches can receive either of two electronic cards having identical interfaces but different lengths.

In order to achieve the above object, the present invention provides a locking means for a card edge connector, which is mounted on a circuit board together with a connecting head of the card edge connector. The locking means includes a pair of locking devices attached on both sides of the circuit board spaced from and at opposite ends of the connecting head. The two locking devices and the connecting head together form a card-inserting space. Each locking device extends to have a first elastic arm. A free end of each locking device is provided with a first locking portion that is adjacent to the connecting head and extends into the card-inserting space. Further, each locking device extends and has a second elastic arm. A free end thereof is provided with a second locking portion that is departed from the connecting head and extends into the card-inserting space.

Therefore, with the first locking portion locking a half (length) type electronic card and the second locking portion locking a full (length) type electronic card, two electronic cards having two identical interfaces but different lengths can be connected and inserted, thereby reducing production costs.

In order to further understand the characteristics and technical contents of the present invention, a detailed description related thereto will be explained with reference to the accompanying drawings. However, it should be understood that the drawings and the description are illustrative and are not intended to limit the scope of the present invention.

DETAILED DESCRIPTION OF THE INVENTION

Figure 1:
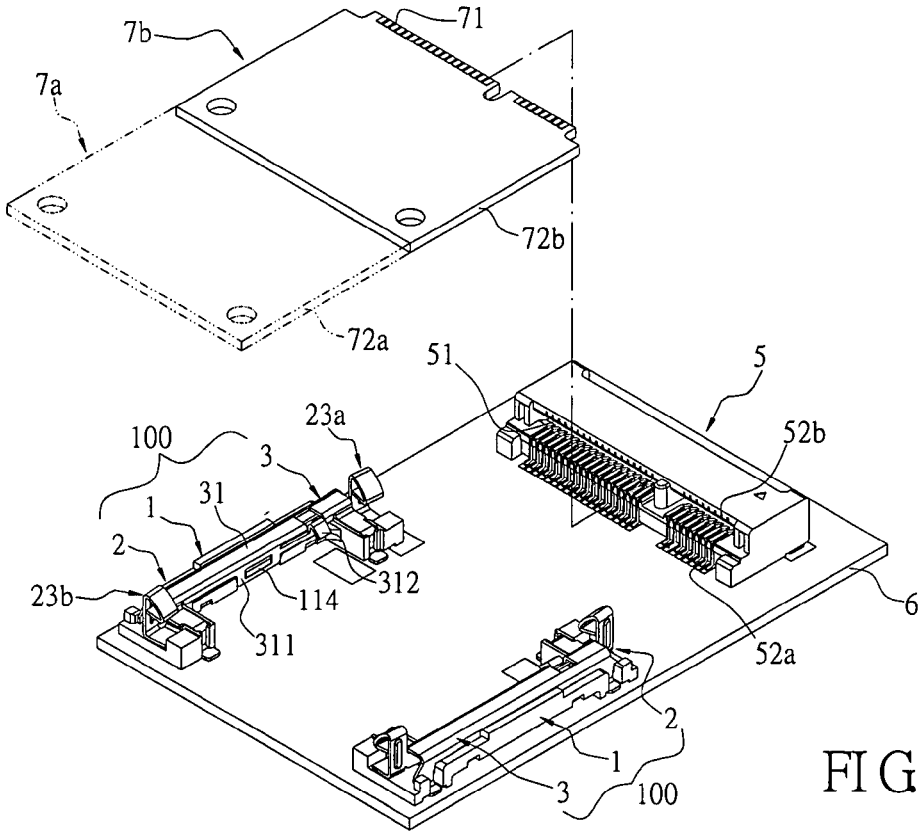
FIG. 1 is an exploded perspective view showing the locking means for a card edge connector of the present invention and a first type of electronic card with a second type of electronic card shown in phantom.

Referring first to FIG. 1, latches or locking structure or means 100 is mounted on a circuit board 6 together with a connector or connecting head 5 which together form a card edge connector. This connector is capable of receiving and locking two electronic cards 7*a*, 7*b* having identical interfaces but different lengths. The connecting head or housing 5 is formed with an insertion slot 51 and has a plurality of terminals 52*a*, 52*b*. One end of each terminal 52*a*, 52*b* is soldered on the circuit board 6. The other end is divided into an upper row and a lower row that each extend along the insertion slot 51. First, the front edge 71 of the two electronic cards 7*a*, 7*b* is inserted into the insertion slot 51 obliquely. Then, the opposite or rear end of the cards is rotated downwardly so that side edges 72*a*, 72*b* on both sides of the electronic cards are pressed downwardly to lock into the locking means 100 of the card edge connector.

The locking means 100 includes a pair of locking devices provided separately on both sides of the circuit board 6 with respect to the connecting head 5. The two locking devices and the connecting head 5 together to form a card-inserting space. Each locking device includes an insulating base 1, a metallic locking piece 2, and a metallic frame 3. The metallic locking piece 2 is attached onto the insulating base 1 separately, thereby locking the side edges 72*a*, 72*b* of the two electronic cards 7*a*, 7*b* to attach them on the insulating base 1. In the present embodiment, the metallic frame 3 not only covers the metallic locking piece 2 to protect it, but also secures the insulating base 1 on the circuit board 6 to form a much firmer structure.

Figure 2:
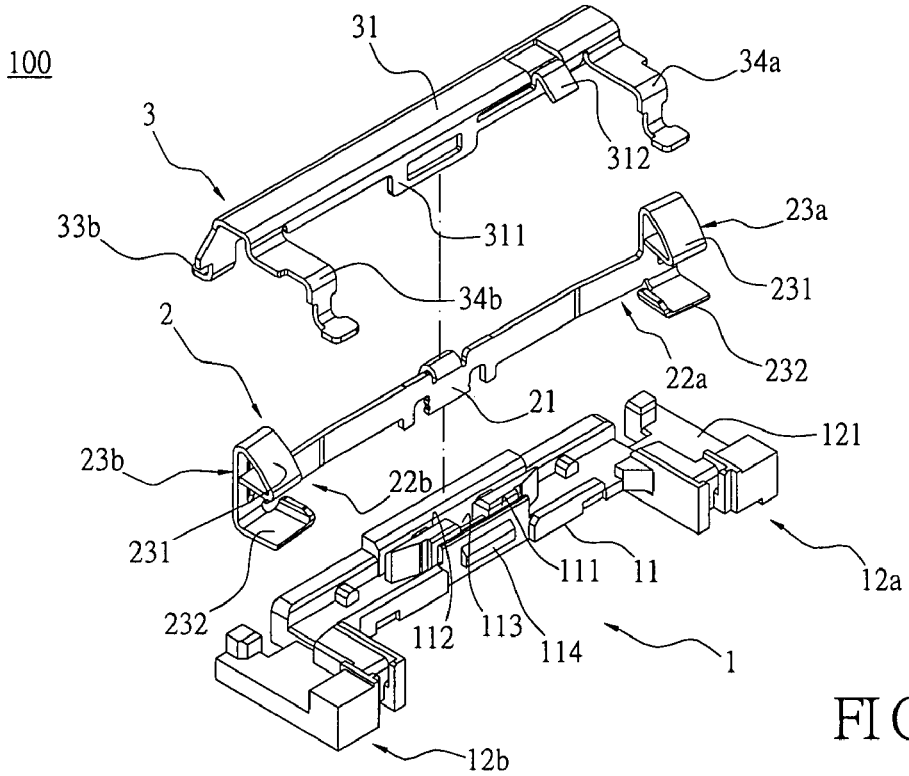
FIG. 2 is an exploded perspective view showing the locking means for the present invention.
Figure 3:
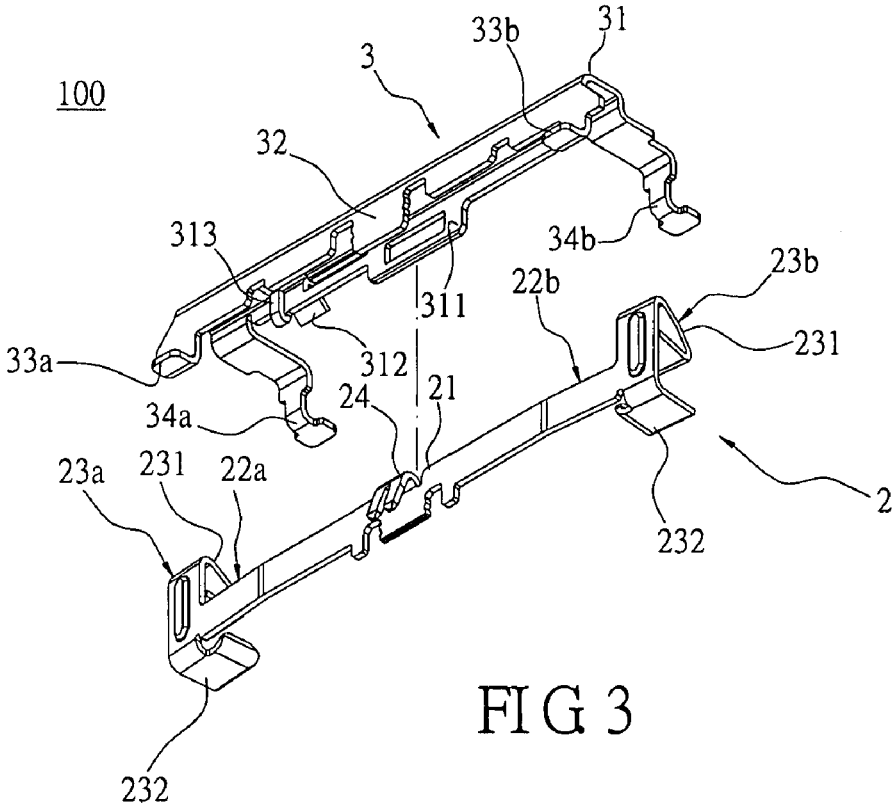
FIG. 3 is an exploded perspective view showing the metallic locking piece and the metallic frame of the locking means for the present invention taken from another viewing angle.

Referring to FIGS. 2 and 3, a pair of insulating bases 1, metallic locking pieces 2, and metallic frames 3 are each provided with a symmetrical structure. In FIGS. 2 and 3, only the left-side structure thereof is shown.

The insulating base 1 has a body portion 11, a first receiving portion 12*a* extending from the front end of the body portion 11 towards the connecting head 5, and a second receiving portion 12*b* extending from the rear end away from the connecting head 5. The first receiving portion 12*a* and the second receiving portion 12*b* are attached on one side of the circuit board 6. The body portion 11 is formed with a first fixing trough or recess 111, and a second fixing trough or recess 112 adjacent to one side of the first fixing trough 111.

The metallic locking piece 2 has a fixing portion 21, a first elastic arm 22*a* extending from the front end of the fixing portion 21 towards the connecting head 5, and a second elastic arm 22*b* extending from the rear end away from the connecting head 5. The free ends of the first and second elastic arms 22*a*, 22*b* are formed into locking portions 23*a*, 23*b*, respectively. The locking portions 23*a*, 23*b* extend into the card-inserting space. The bottom of the fixing portion 21 is formed with a plurality of barbs so that it can be attached into the first fixing trough 111. The top edge of the fixing portion 21 is bent outwardly and elastically or resiliently to define a contacting portion 24.

The metallic frame 3 has a top plate 31, a communicating portion 32 extending downwardly from a middle position of an outer edge of the top plate 31 to abut against the contacting portion 24 of the metallic locking piece 2, a pair of grounding portions 33*a*, 33*b* bent and extending downwardly from the outer edges of the front and rear sides of the top plate 31 so as to be attached on the circuit board 6 (that is, each is soldered to the circuit board 6 to form a grounding state) and a pair of legs 34*a*, 34*b* bent and extending downwardly from the inner edges of the front and rear sides of the top plate 31 so as to be attached on the circuit board 6 (that is, each is soldered to the circuit board 6). With this arrangement, the metallic frame 3 can further secure the insulating base 1 onto the circuit board 6. Further, the first elastic arm 22*a* and the second elastic arm 22*b* of the metallic locking piece 2 can move elastically within the metallic frame 3. More specifically, the grounding portions 33*a*, 33*b* and the legs 34*a*, 34*b* are a plurality of soldering portions that are soldered to the circuit board 6. The soldering portions can be grounded selectively as desired.

In the present embodiment, the communicating portion 32 of the metallic frame 3 abuts against the contacting portion 24 so as to be attached on the insulating base 1. Both sides of the communicating portion 32 are formed with a plurality of barbs to be attached into the second fixing trough 112. The body portion 11 of the insulating base 1 is formed with a through trough 113 between the first fixing trough 111 and the second fixing trough 112, thereby allowing the contacting portion 24 to be electrically connected with the communicating portion 32 via the through trough 113. The inner end of the body portion 11 of the insulating base 1 is formed with a locking block 114. Further, the inner end of the top plate 31 of the metallic frame 3 extends downwardly to form a locking portion 311 to be locked on the locking block 114.

Moreover, the inner edge of the top plate 31 of the metallic frame 3 is bent and extends to have an elastic or resilient activating piece 312 that extends into the card-inserting space and is adjacent to the inside of the first elastic arm 22*a*. The activating piece can push the first elastic arm 22*a* to move due to the effect of an external force. The activating piece 312 extends toward the first elastic arm 22*a* to have an extending portion 313, thereby reducing the necessary distance of the activating piece 312 for abutting against the first elastic arm 22*a*. Each of the first and second receiving portions 12*a*, 12*b* of the insulating base 1 is formed with a flat surface 121. The locking portion 23*a*, 23*b* of the first elastic arm 22*a* and the second elastic arm 22*b* are located on the corresponding flat surface 121, and can move on the flat surface 121 to lock or depart from the two electronic cards 7*a*, 7*b* respectively.

The locking portions 23*a*, 23*b* of the locking means 100 of the present invention each comprise a pressing piece 231 and a stopping piece 232. The pressing piece 231 is bent inwardly from the top edge of the free end of the first elastic arm 22*a* and the second elastic arm 22*b* respectively, and has a slope for guiding the insertion of the electronic card. The stopping piece 232 is bent inwardly from the bottom edge of the free end of the first elastic arm 22*a* and the second elastic arm 22*b*. The stopping piece 232 can prevent the inserted electronic card 7*a*, 7*b* from moving excessively downward. In the present embodiment, each stopping piece 232 has a flat bottom surface that can be disposed on the flat surfaces 121 of the first and second receiving portions 12*a*, 12*b* slidably.

According to the above, and with reference to FIG. 1 and FIG. 2, the locking means for the card edge connector of the present invention can lock two electronic cards having identical interfaces but different lengths in such a way that the locking portions 23*a*, 23*b* of the first elastic arm 22*a* and the second elastic arm 22*b* of the metallic locking piece 2 lock the electronic card having a longer side edge and the electronic card 7*b* having a shorter side edge, respectively. In the present embodiment, a full type electronic card 7*a* and a half type electronic card 7*b* are used.

When the side edge 72*a* of the full type electronic card 7*a* is pressed and locked to the locking means 100, in the present embodiment, the side edge of the electronic card 7*a* abuts against the activating piece 312 of the metallic frame 3, so that the activating piece 312 pushes the first elastic arm 22*a* to move outwardly and causes the locking portion 23*a* to depart from the side edge 72*a* of the electronic card 7*a*, thereby avoiding locking the electronic card 7*a* (in a position where it cannot be ejected). The side edges 72*a* on both sides of the rear edge of the electronic card 7*a* are locked into the locking portion 23*b* of the second elastic arm 22*b*. When the electronic card 7*a* is ejected, a user only needs two fingers to turn the locking portion 23*b* of the second elastic arm 22*b*, so that the electronic card 7*a* can be ejected easily.

It should also be noted that the activating piece 312 can be moved selectively. To perform this action, the locking portions 23*a*, 23*b* are locked to the side edge 72*a* of the electronic card 7*a* simultaneously. When the electronic card is ejected, the user needs four fingers to turn the locking portions 23*a*, 23*b*.

In addition, the side edges 72*b* on both sides of the rear edge of another half type electronic card 7*b* are locked into the locking portion 23*a* of the first elastic arm 22*a*. According to the above description and figures, the electronic card 7*b* does not abut against the activating piece 312 of the metallic frame 3, and thus does not cause an outward movement of the first elastic arm 22.

Figure 4:
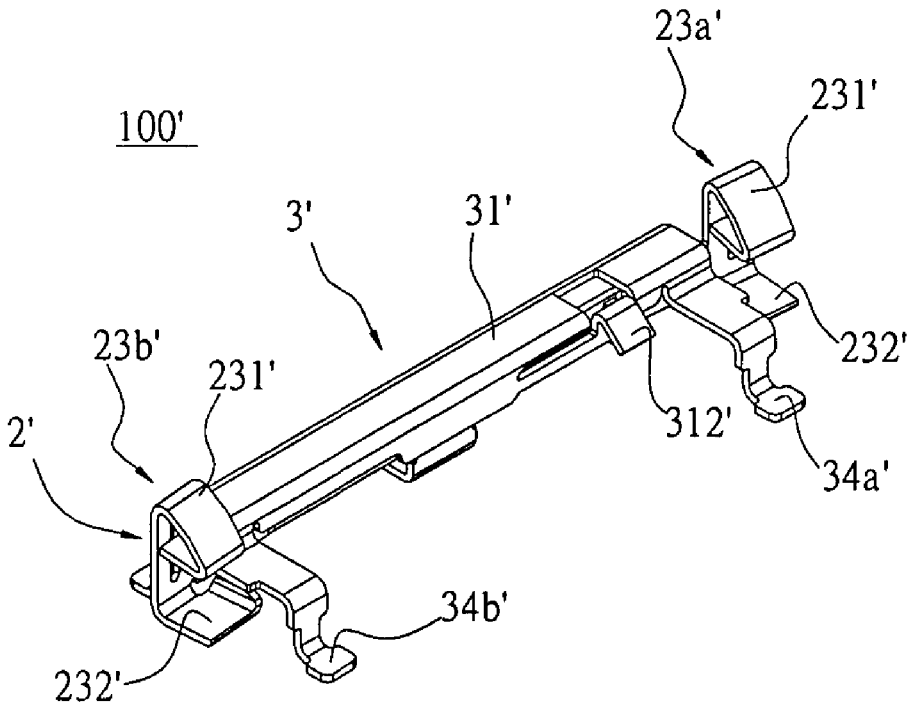
FIG. 4 is a perspective view showing a second embodiment of the metallic locking piece of the locking means in accordance with the present invention.
Figure 5:
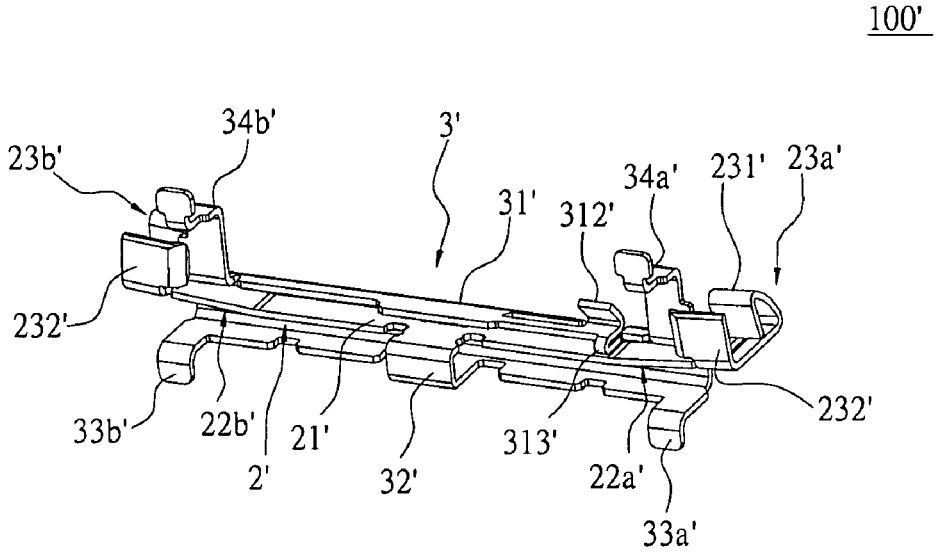
FIG. 5 is a perspective view from the bottom of the second embodiment of the metallic locking piece of the locking means in accordance with the present invention taken.

FIGS. 4 and 5 depict a portion of a second embodiment of the locking means 100'. A pair of locking devices would be provided separately on both sides of the circuit board with respect to the connecting head (not shown). The two locking devices and the connecting head define a card-inserting space (not shown) as with the first embodiment. The locking device includes a metallic locking piece 2' and a metallic frame 3'. The difference between the first embodiment and the second embodiment is that each of the metallic locking piece 2' and the metallic frame 3' are formed of a single, unitary metal plate. In this way, the metallic locking piece 2' is formed as a portion of metallic frame 3' rather than two components assembled together. Only the left-side structure thereof is shown in the drawings of the present invention.

The metallic frame 3' has a top plate 31' and a communicating portion 32'. The metallic locking piece 2' has a fixing portion 21', a first elastic arm 22*a*', a second elastic arm 22*b*', and two locking portions 23*a*', 23*b*'. The communicating portion 32' is bent and extends inwardly from the outer edge of the top plate 31' so as to be connected with the fixing portion 21' integrally, thereby allowing the metallic frame 3' to be electrically connected with the metallic locking piece 2'. The first elastic arm 22*a*' is formed by extending the front end of the fixing portion 21' toward the connecting head. The second elastic arm 22*b*' is formed by extending the rear end of the fixing portion 21' to depart from the connecting head. The first elastic arm 22*a*' and the second elastic arm 22*b*' of the metallic locking piece 2' can move resiliently within the metallic frame 3'. The two locking portions 23*a*', 23*b*' are formed on the free ends of the first and second elastic arms 22*a*', 22*b*' respectively. The locking portions 23*a*', 23*b*' extend into the card-inserting space.

Figure 6:
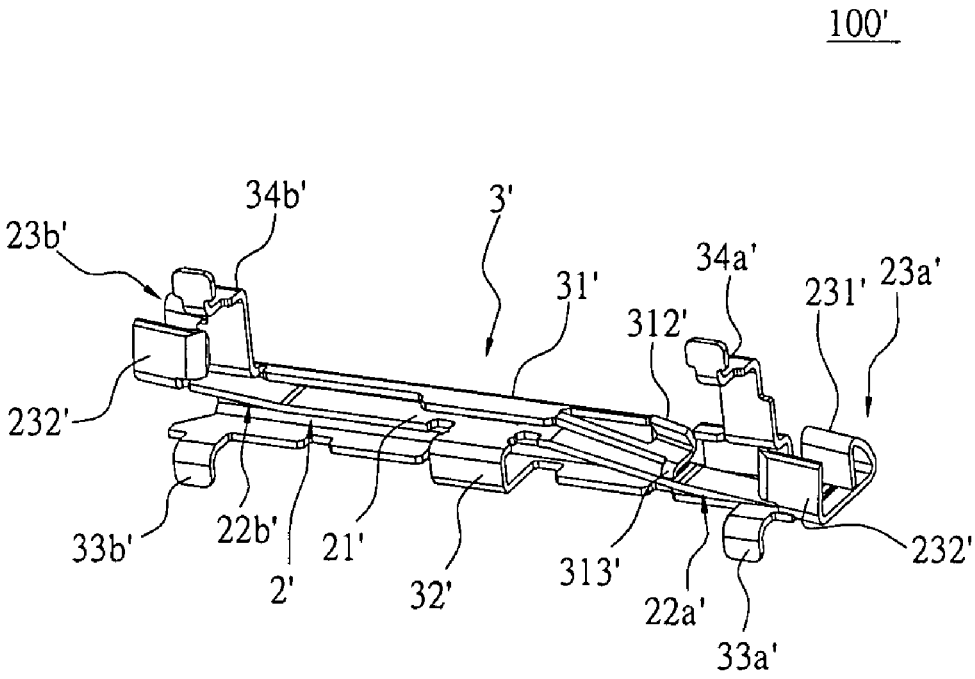
FIG. 6 is a perspective view similar to FIG. 5 but showing the activating piece retracted to permit withdrawal of an electronic card showing a push-and-move state of FIG. 5.

The inner edge of the top plate 31' is bent and extends to form an elastic or resilient activating piece 312' that extends into the card-inserting space and is adjacent to the inside of the first elastic arm 22*a*'. The activating piece 312' pushes the first elastic arm 22*a*' to move due to the effect of an external force, as is shown in FIG. 6. The activating piece 312' further extends toward the first elastic arm 22*a*' to have an extending portion 313', thereby reducing the necessary distance of the activating piece 312' for abutting against the first elastic arm 22*a*'.

More specifically, each of the locking portions 23*a*', 23*b*' of the locking means 100' of the second embodiment comprises a pressing piece 231' and a stopping piece 232'. The pressing piece 231' is bent inwardly from the top edges of the free ends of the first and second elastic arms 22*a*', 22*b*' respectively. The pressing piece 231' has a slope for guiding the insertion of the electronic card. The stopping piece 232' is bent inwardly from the bottom edges of the free ends of the first and second elastic arms 22*a*', 22*b*'.

The outer edges of the front and rear sides of the top plate 31' are bent downwardly to form a pair of grounding portions 33*a*', 33*b*' configured to be soldered to the circuit board to form a ground connection and also fix the top plate 31'. The inner edges of the front and rear sides of the top plate 31' are bent downwardly to form a pair of legs 34*a*', 34*b*' also configured to be soldered to the circuit board in order to attach the top plate 31' to the circuit board. Via the above arrangement, a locking means 100' having the same effects as the first embodiment can be achieved.

Although the present invention has been described with reference to the foregoing preferred embodiments, it will be understood that the invention is not limited to the details thereof. Various equivalent variations and modifications can still occur to those skilled in this art in view of the teachings of the present invention. As an example, if desired, the pair of insulating bases 1 could be integrally formed with connector housing 5 as shown in dotted lines in FIG. 1. Thus, all such variations and equivalent modifications are also embraced within the scope of the invention as defined in the appended claims.

What is claimed is:

1. A card edge connector for receiving and locking an electronic card therein, said electronic card having either of two different lengths, said connector comprising:

a connector housing having a slot for receiving a mating edge of the electronic card therein; a plurality of terminals mounted in the connector housing with a portion of each terminal extending along the slot for electrical connection with a portion of said card; and a pair of generally elongated parallel, spaced apart locking devices, each locking device being aligned and positioned along an opposite end of said connector housing and, together with said connector housing, define a card receiving space, each of said locking devices having first and second spaced apart locking portions, the first locking portions being positioned generally adjacent the connector housing and the second locking portions being positioned a second distance from said connector housing further from said connector housing than said first locking portions;

whereby said first locking portions lock an electronic card having a first length and said second locking portions lock an electronic card having a second length, said first length being shorter than said second length.

2. The card edge connector according to claim 1, wherein each locking device further includes a stopping piece to define a lower boundary of said card receiving space.

3. The card edge connector according to claim 1, further including metallic legs for soldering the locking devices to a circuit board.

4. The card edge connector according to claim 3, wherein the metallic legs are grounded selectively.

5. A card edge connector for receiving and locking an electronic card therein, said electronic card having either of two different lengths, said connector comprising:

a connector housing having a slot for receiving a mating edge of the electronic card therein; a plurality of terminals mounted in the connector housing with a portion of each terminal extending along the slot for electrical connection with a portion of said card; and a pair of generally elongated parallel, spaced apart locking devices, each locking device being aligned and positioned along an opposite end of said connector housing and, together with said connector housing, define a card receiving space, each of said locking devices having first and second spaced apart locking portions, the first locking portions being positioned generally adjacent the connector housing and the second locking portions being positioned a second distance from said connector housing further from said connector housing than said first locking portions;

whereby said first locking portions lock an electronic card having a first length and said second locking portions lock an electronic card having a second length, said first length being shorter than said second length; and wherein the connector housing and plurality of terminals are configured to receive the mating edge of the electronic card at a first angular insertion orientation and permit the card to be subsequently rotated to a second, operative angular orientation.

6. A card edge connector for receiving and locking an electronic card therein, said electronic card having either of two different lengths, said connector comprising:

a connector housing having a slot for receiving a mating edge of the electronic card therein; a plurality of terminals mounted in the connector housing with a portion of each terminal extending along the slot for electrical connection with a portion of said card; and a pair of generally elongated parallel, spaced apart locking devices, each locking device being aligned and positioned along an opposite end of said connector housing and, together with said connector housing, define a card receiving space, each of said locking devices having first and second spaced apart locking portions, the first locking portions being positioned generally adjacent the connector housing and the second locking portions being positioned a second distance from said connector housing further from said connector housing than said first locking portions;

whereby said first locking portions lock an electronic card having a first length and said second locking portions lock an electronic card having a second length, said first length being shorter than said second length; and wherein each locking device includes a pair of resilient, deflectable arms with one of said first and second locking portions thereon.

7. The card edge connector according to claim 6, wherein the locking portions include a pressing piece extending from each deflectable arm toward the card receiving space, and the pressing piece has a guiding slope to engage a side edge of said electronic card as said card is inserted into said connector.

8. The card edge connector according to claim 6, wherein each locking device includes an elastic activating piece that extends into the card receiving space and is adjacent to the inside of one of the deflectable arms.

9. The card edge connector according to claim 8, wherein the activating piece includes an extending portion extending toward said one of the deflectable arms.

10. A card edge connector for receiving and locking an electronic card therein, said electronic card having either of two different lengths, said connector comprising:

a connector housing having a slot for receiving a mating edge of the electronic card therein; a plurality of terminals mounted in the connector housing with a portion of each terminal extending along the slot for electrical connection with a portion of said card; and a pair of generally elongated parallel, spaced apart locking devices, each locking device being aligned and positioned along an opposite end of said connector housing and, together with said connector housing, define a card receiving space, each of said locking devices having first and second spaced apart locking portions, the first locking portions being positioned generally adjacent the connector housing and the second locking portions being positioned a second distance from said connector housing further from said connector housing than said first locking portions;

whereby said first locking portions lock an electronic card having a first length and said second locking portions lock an electronic card having a second length, said first length being shorter than said second length; and wherein each locking device includes an insulating base and an elongated, metallic locking piece, said locking piece having a fixing portion attached to the insulating base and a first resilient arm extending towards the connect housing, and a second resilient arm extending away from the connector housing.

11. The card edge connector according to claim 10, wherein said connector housing and each of said locking devices are separate components mounted separately on a circuit board.

12. A card edge connector for receiving and locking an electronic card therein, said electronic card having either of two different lengths, said connector comprising:

a connector housing having a slot for receiving a mating edge of the electronic card therein; a plurality of terminals mounted in the connector housing with a portion of each terminal extending along the slot for electrical connection with a portion of said card; and a pair of generally elongated parallel, spaced apart locking devices, each locking device being aligned and positioned along an opposite end of said connector housing and, together with said connector housing, define a card receiving space, each of said locking devices having first and second spaced apart locking portions, the first locking portions being positioned generally adjacent the connector housing and the second locking portions being positioned a second distance from said connector housing further from said connector housing than said first locking portions;

whereby said first locking portions lock an electronic card having a first length and said second locking portions lock an electronic card having a second length, said first length being shorter than said second length; and wherein the locking device is an integrally formed member including a locking piece and a frame, the locking piece being connected to the frame and accommodated therein, the locking piece having a first resilient arm extending toward the connector housing and a second resilient arm extending away from the connector housing.

13. The card edge connector according to claim 12, wherein the frame has a plurality of soldering portions that extend from an edge of the frame and configured to be soldered to a circuit board.

* * * * *